United States Patent [19]

Wheeler

[11] 4,076,602

[45] Feb. 28, 1978

[54] METHOD OF PRODUCING MAGNESIUM METAL AND CHLORINE FROM $MgCl_2$ CONTAINING BRINE

[76] Inventor: Roger M. Wheeler, 1957 E. 41, Tulsa, Okla. 74105

[21] Appl. No.: 567,512

[22] Filed: Apr. 14, 1975

[51] Int. Cl.[2] ..... C25C 3/04; C25C 3/12; C25C 3/08

[52] U.S. Cl. ..... 204/70; 204/245; 204/237; 204/243 R; 423/178; 423/497; 423/498

[58] Field of Search ..... 204/70; 423/178, 497, 423/498

[56] References Cited

U.S. PATENT DOCUMENTS

| | | | |
|---|---|---|---|
| 1,755,380 | 4/1930 | Barstow | 204/70 |
| 1,863,221 | 6/1932 | Heath | 204/70 |
| 1,900,220 | 3/1933 | Barstow | 204/145 X |
| 2,951,021 | 8/1960 | Di Pietro | 204/64 T |
| 2,974,093 | 3/1961 | Bauer et al. | 204/70 |
| 3,512,928 | 5/1970 | Lyons et al. | 204/70 X |
| 3,661,738 | 5/1972 | Wheeler et al. | 204/70 |

*Primary Examiner*—F.C. Edmunson
*Attorney, Agent, or Firm*—Head, Johnson & Chafin

[57] ABSTRACT

A method of producing magnesium and chlorine including the steps of injecting concentrated magnesium chloride containing brine into a hot gas spray drier wherein most of the water is evaporated to produce cell feed in the form of a powder of high porosity discrete particles of impure $MgCl_2$, the impure particles being purified by in situ reaction within an electrolytic cell by depositing the particles onto an area of the surface of molten electrolyte whereby a portion of the entrained impurities are vaporized and withdrawn and circulating the electrolyte through the interelectrode space where the remaining impurities are chlorinated by chlorine gas produced at the anode, the circulation being at a rate to entrain most of the magnesium oxide particles in suspension for reaction with chlorine gas generated at the anode element. The molten magnesium produced at the cathode is withdrawn in the usual manner.

9 Claims, 5 Drawing Figures

METHOD OF PRODUCING MAGNESIUM METAL AND CHLORINE FROM $MgCl_2$ CONTAINING BRINE

BACKGROUND OF THE INVENTION

Electrolytic processes for the production of magnesium metal are generally based upon the reduction of magnesium chloride resulting in the generation of magnesium metal and chlorine. When a cell is fed with a very pure magnesium chloride, particularly when free from such impurities as iron, boron, nickel, copper, sulfates, magnesium oxide and water, it is relatively easy to design a cell which operates very efficiently and which produces high quality magnesium and chlorine gas, both of which have high market value. As the quantity of impurities in the magnesium chloride fed to the cells is increased the design and operation of the cell become more complex, the efficiency of the cell is lowered and the quality of the products suffers. Accordingly, practical cell designs in production use today reflect the compromises required by impurities in the magnesium chloride cell feed.

Some impurities in cell feed, such as iron, boron, nickel, copper and sulfates, are easily controllable by conventional chemical engineering methods. The preparation of inexpensive magnesium chloride cell feed, however, which is free from oxygen and hydrogen containing impurity has eluded the industry, despite intensive research for more than 50 years.

Most of the magnesium chloride cell feed used in the production of electrolytic magnesium is obtained from sea water. In order to use sea water as a source of magnesium the usual procedure is to treat the sea water with an alkali in order to concentrate the magnesium component as a hydroxide which is a solid and can, therefore, be separated easily from the sea water. In this process, however, the chlorine produced in the electrolysis of the magnesium chloride cell feed must be used in converting the hydroxide into magnesium chloride and therefore does not result in the production of saleable chlorine.

An objective of the industry for many decades has been the production of anhydrous and magnesium oxide free magnesium chloride cell feed by the dehydration of concentrated brines, either naturally occurring, such as from the Great Salt Lake in Utah, or from the bitterns of other salt processing operations, such as from potash production. Industry, however, has not been successful in finding a way to commercially dehydrate brine to obtain completely anhydrous magnesium chloride cell feed free of magnesium oxide. The reason is that the chemical equilibria of the reactions which occur during the dehydration of magnesium chloride brine are such that hydrolysis occurs and a portion of the magnesium chloride is converted to magnesium oxide, particularly during the last stage of dehydration. The hydrolysis reactions can be inhibited if the dehydration is performed in an atmosphere of certain chlorine compounds, such as hydrogen chloride or phosgene. The principal economic and technical difficulties associated with such reagents result from their aggressiveness to available engineering materials of construction and the hazards involved in their use.

Another method of inhibiting hydrolysis during dehydration of magnesium chloride is to dry the magnesium chloride under non-equilibrium conditions such as by the use of commercially available spray dryer equipment. Those skilled in the spray drying of magnesium chloride brine are able to produce magnesium chloride cell feed containing no more than 5% each of magnesium oxide and water. Magnesium chloride cell feed containing this range of impurities, however, normally causes passivation of cell cathodes, reduced cell efficiency and the generation of a large amount of cell sludge.

Removing cell sludge is costly. In addition, cell sludge entraps metal, thereby reducing the overall efficiency of the cell and if the sludge accumulation is not timely removed, it will accumulate sufficiently to short out the electrodes.

Therefore, it is customary to practice further purification before it can be used as a practical cell feed.

Such purification can be accomplished by the chlorination or phosgenation of the remelted spray dried magnesium chloride powder, which eliminates the water and converts the magnesium oxide impurity to magnesium chloride. The efficiency of these reactions is relatively low, resulting in the excessive use of chlorine or phosgene. Equipment costs and hazards are high. Accordingly, this method has not yet been reduced to industrial scale practice.

Another method of purifying magnesium chloride cell feed is to (1) melt the impure powder, to (2) remove the contained water by chemical dehydrogenation using a suitable gas or by reaction with a suitable metal, and to (3) physically remove the solid magnesium oxide by settling and decanting the purified magnesium chloride liquor, or by the use of centrigues or filtering devices. This method has both technical and economic disadvantages. The particles of magnesium oxide impurity are usually submicron to micron in size and thus are extremely difficult to remove from liquid magnesium chloride. The very small particles of magnesium oxide which are then carried into the cell with the feed have been found to be the most troublesome form of magnesium oxide in causing cathode passivation and reduced cell efficiency. Moreover, during the melting of the spray dried powder additional hydrolysis occurs, forming additional magnesium oxide. During the physical separation of the magnesium oxide from the purified magnesium chloride substantial amounts of magnesium chloride are entrapped within the interstices of the magnesium oxide, resulting in excessive loss of the valuable magnesium chloride feed in the waste sludge. The high cost of dehydrogenation of the melt, either by the use of a purging gas at elevated temperature or by the use of a metal which acts as a scavenger increases the serious economic problems associated with this purification procedure.

This invention is directed to a method for purifying spray dried magnesium chloride of its water and magnesium oxide impurities which is economical and avoids the technical difficulties of the other purification schemes described briefly above. This method comprises the in situ final purification of the spray dried magnesium chloride within the electrolytic cell itself by appropriate cell design and operation and the feeding of the spray dried powder having preselected physical and chemical ahcaracteirstics directly to the cell in the proper manner.

Feeding a magnesium electrolytic cell with an unmelted granular feed is not new to the art and is referred to in the nomenclature of the trade as "solid feed." At least one commercial producer feeds its magnesium cells with a coarse granular magnesium chloride feed containing typically 20% water impurity. However, the resulting chlorine coproduct of this cell is seriously contaminated with a large amount of hydrogen chloride and large quantities of sludge are produced. In times of emergency operators of the I. G. Farben type of magnesium electrolysis cell have been known to dry charge coarse feed directly to the cell, but such dry charging is not commonly practiced because of operational difficulties and poor economics.

This invention relates to the discovery that when powdered spray dried magnesium chloride feed containing small amounts of hydrogen and oxygen containing impurities is fed under the proper conditions to a cell of suitable design that: (1) the magnesium chloride powder melts instantaneously, with the evaporation of a substantial portion of the hydrogen containing impurities, which then is immediately removable from the cell (2) hydrolysis of the swiftly melted powder is substantially eliminated by its speed of melting and its immediate entrainment in the circulating electrolyte; (3) the impure feed is carried by the circulating electrolyte immediately into the anode-cathode space, before the impurities have had an opportunity to settle to the bottom of the cell; (4) substantially all of the magnesium oxide particles and the remaining water are chlorinated in the anode-cathode space by the cell chlorine produced at the anode; and (5) superior cell performance is obtained, with the production of high quality chlorine co-product and an extremely high magnesium ion efficiency is achieved.

OBJECTS OF THE INVENTION

It is a primary object of this invention to provide an improved method of producing magnesium metal and chlorine in an electrolysis cell utilizing powdered magnesium chloride cell feed.

Another object of this invention is to provide a method of producing magnesium metal and chlorine utilizing a magnesium chloride cell feed in the form of discrete highly porous particles, including a method whereby final purification of the cell feed is achieved within the cell itself.

Another object of this invention is to provide a method of producing magnesium metal and chlorine in an electrolytic cell in a manner wherein a significant reduction is obtained in the sludge produced, wherein improved current efficiencies are obtained, wherein higher production rates are achieved, and wherein decreased costs of cell feed preparation result. These objects, as well as other more specific objects of the invention will be fulfilled in the following description and claims, taken in conjunction with the attached drawings.

SUMMARY OF THE INVENTION

The essence of this invention is the discovery that magnesium chloride cell feed produced by practicing spray drying to attain a powdered material wherein the magnesium chloride content is at least 50%, wherein the hydrogen contaminant content is less than 1% and the oxygen contaminant content is less than 13% and wherein the average porosity of the particles is greater than 30%, can be used directly, without further purification, as a feed material for electrolytic cells, when the feed material is deposited on the surface of an electrolyte circulating at a rate sufficient to maintain most of the magnesium oxide contaminant in suspension, the initial contact of the powdered cell feed onto the hot electrolyte surface serving to flash off by rapid vaporization a portion of the hydrogen and oxygen impurities, the balance of such impurities being consumed by chemical reactions in the cell. Thus, it can be said that the final cell feed purification is accomplished in situ, that is, within the cell itself. The result is the electrolytic production of magnesium in a manner producing less sludge, increased magnesium ion efficiency, reduced cell feed preparation costs, increased cell amperage and therefore increased production capacity, and the production of saleable chlorine.

DESCRIPTION OF VIEWS

DETAILED DESCRIPTION

Figure 1:
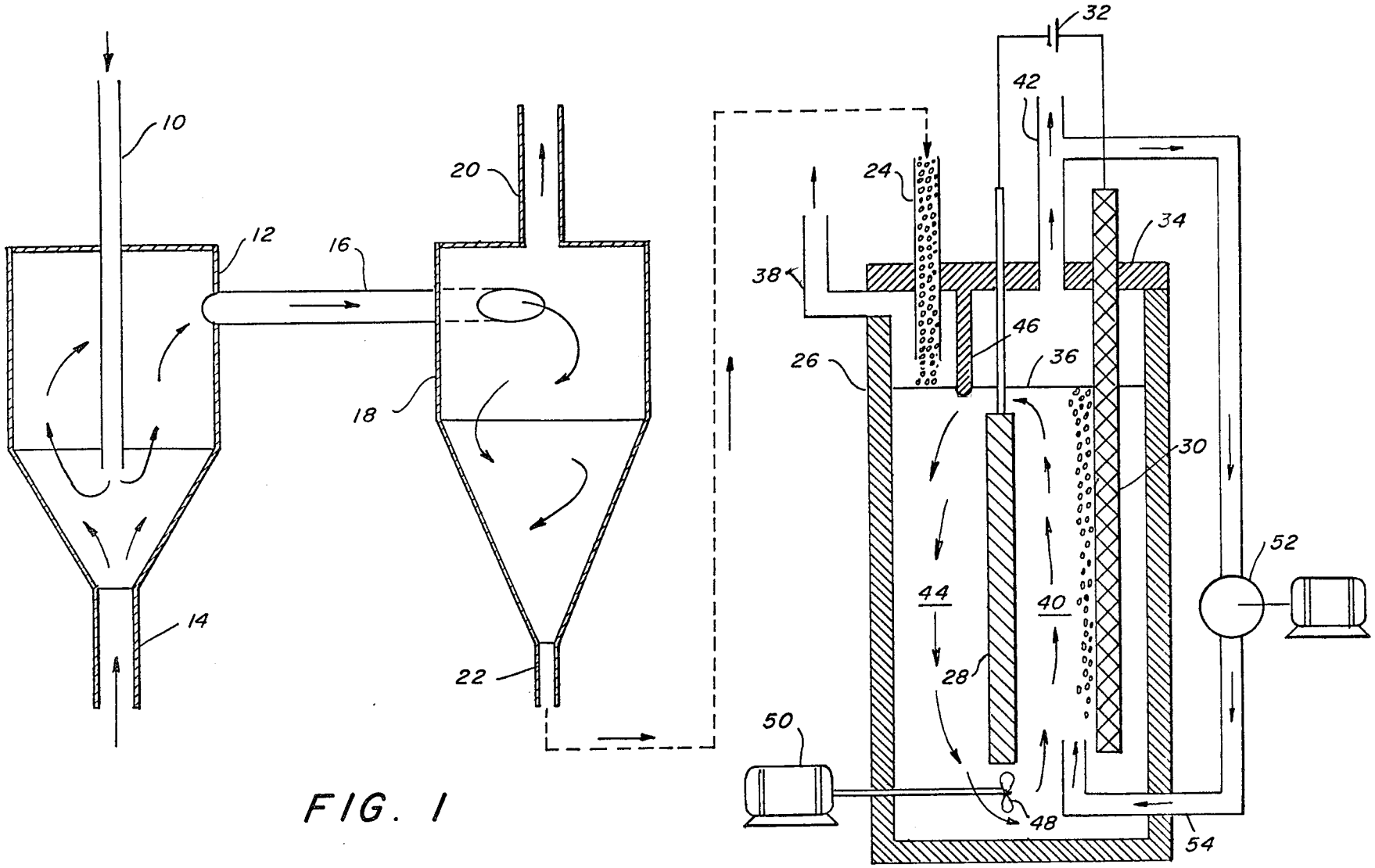
FIG. 1 is a diagrammatic view of the basic apparatus used to practice the invention, the apparatus being illustrated in cross-section.

The principles of the process of this invention can best be understood by reference to the simplified schematic drawing shown in FIG. 1.

Magnesium chloride brine, which has been concentrated in preliminary steps, such as in solar ponds or the like and which has been treated to remove iron, boron, nickel, copper, sulfates and other contaminates, is fed through inlet 10 to a spray dryer 12. Hot, dry air is injected into the spray dryer at inlet 14. In spray dryer 12 substantially all the water of the brine is evaporated. The magnesium chloride content of the brine is left in the form of discrete porous particles. The particles are carried from the spray dryer through pipe 16 into a cyclone separator 18. Here, by centrifugal force, the particles are separated from the air stream and collect in the bottom of the separator, the air passing through outlet pipe 20.

From the lower outlet 22 of the separator 18 powdered cell feed is fed through intervening storage and transporting equipment, not shown, to the cell feed input 24 of an electrolytic cell 26. A vertical section is shown of cell 26 in diagrammatic form. The actual appearance of an electrolytic cell varies greatly from the simplified embodiment shown for purposes of exemplifying the invention. The details of construction of cell 26 are not part of this invention as the same are well known by those experienced in the engineering design of electrolytic magnesium producing cells.

Cell 26 includes a steel cathode 28 and a graphite anode 30, these electrodes being connected to an external direct current power source 32. For purposes of simplicity the anode and cathode are shown suspended in the cell through a cover 34. Inlet tube 24 delivers the powdered cell feed to the surface of the electrolyte 36 where it melts immediately and is drawn downward by the circulating electrolyte toward the bottom of the cell. When the powdered cell feed contacts the hot surface of the electrolyte 36 a significant portion of the hydrogen and oxygen containing contaminants are vaporized.

The electrolytic action in the cell takes place in the inter-electrode space 40. The chlorine ions migrate to the anode 30 and the magnesium ions to cathode 28. The chlorine gas accumulated at the anode rises in the electrolyte and is drawn from the cell through chlorine outlet 42. The magnesium metal accumulates as globules at the cathode and is carried by the circulating electrolyte into a metal removal area. To separate area 44 of the cell from the inter-electrode space 40 at which chlorine gas is generated, an upper semi-wall 46 extends downwardly from cover 34 to just below the surface of electrolyte 36.

It should be understood that for purposes of simplicity and clarity no provision is shown in this figure for collection and removal of the magnesium product, which is accomplished by following the conventional practice. Also, while only a pair of anode and cathode elements is shown, normally a multiplicity of such pairs is used. Circulation of the electrolyte 36 shown by the arrows is accomplished by the gas lift action in the anode-cathode space 40 produced by the buoyancy of the chlorine gas produced and assisted by the additional gas lift effect of gases produced during purification. It should be understood that by practicing the methods of this invention the desired circulation can be achieved with some known cell configurations. Other presently used cell designs are not applicable to the use of the methods of this invention, while still others may be modified to adapt to these methods.

The proper application of the methods of this invention require good circulation of the electrolyte upwardly in the inter-electrode space 40, into the area 44 where the powdered cell melt is deposited. As previously indicated, buoyancy of the electrolyte in the inter-electrode space 40 is induced by the chlorine and other gases produced there. With proper call design sufficient circulation of the electrolyte will be provided by this buoyancy. However, if increased circulation is required, the circulation rate may be augmented, such as by mechanical means represented by propeller 48 rotated by a motor 50 or by means of additional gas lift which can be achieved by recycling a portion of the off gases from outlet 42 through a compressor 52 and back into the lower portion of the inter-electrode space 40 through a conduit 54. The recycled gas, being primarily chlorine, in addition to augmenting electrolyte circulation, insures that oxygen containing impurities will be more thoroughly chlorinated within the cell.

Rapid circulation of the electrolyte in the cell has these primary benefits in practicing the method of this invention: First, a fresh, hot surface of the electrolyte is presented to the powdered cell feed deposited through feed inlet 24. This results in the flash vaporization of oxygen and hydrogen containing components, especially when such components are in the form of water or MgOHCl. This fresh hot surface of molten electrolyte presented to the incoming cell feed particles performs the final dehydralization step of the cell feed preparation. If no electrolyte circulation exists, or if the rate is very slow, the incoming powdered cell feed will tend to accumulate in a cake floating on the electrolyte surface. When this occurs, the cake tends to insulate the incoming cell feed powder from the heat of the electrolyte. Thus the rate of melting of the cell feed is reduced and the opportunity is presented for increased oxidation of the cell feed. By maintaining good electrolyte circulation the possibility of the formation of a cake of cell feed floating on the surface is eliminated and the purifying effect of the contact of the powdered cell feed with the fresh hot surface of the electrolyte is assured.

For most effective utilization of the method of this invention the electrolyte 36 preferably has a magnesium chloride content of about 8 to 17%. Since this concentration level of the electrolyte is far below saturation, the powdered magnesium chloride cell feed is rapidly melted and assimilated in the electrolyte.

A second advantage attained by rapid circulation of the electrolyte is that the cell feed deposited on the surface of the electrolyte is quickly carried into the electrolyte and dissolved, thereby reducing the opportunity for increased oxidation.

Third, a greater portion of the contaminants in the electrolyte are maintained in suspension by the circulation of the electrolyte. A problem common with electrolytic magnesium cells is the accumulation of sludge which settles out of the electrolyte. This material, which includes magnesium oxide, and other components heavier than the electrolyte, as well as a goodly percentage of magnesium metal trapped by the sludge components must be periodically removed, a process which is time consuming and expensive. In addition, the magnesium metal lost in the sludge results in an overall decrease in the efficiency of the cell. Rapidly circulating electrolyte achieved by the principles of this invention maintains a much higher percent of the sludge forming components in circulation in the electrolyte so that they can be purified by reaction with chlorine in the cell. Magnesium oxide, for instance, which is invariably produced in the attempt to completely dehydrate a magnesium chloride brine, is a refractory material and is never melted by the electrolyte. It has been found that the magnesium oxide particles produced by spray drying are small. As long as these small particles can be maintained in suspension an opportunity is presented to react with the chlorine gas produced at the anode, as illustrated in reaction (e) in the following discussion. Thus, by maintaining the magnesium oxide particles in suspension more purification of the cell feed is accomplished in the cell and substantially less sludge is produced. As a consequence of this greatly reduced sludge formation, the magnesium ion efficiency approaches 100%. In other words, substantially all the magnesium contained in the cell feed, both in the magnesium chloride and magnesium oxide state, is collected in the cell as recoverable magnesium metal.

A fourth advantage of high electrolyte circulation rate is that the magnesium metal produced at the cathode is more expeditiously carried out of the inter-electrode space and into the metal removal area. This reduces the opportunity for the magnesium metal to contact the chlorine gas produced at the anode which results in the self defeating recombination to magnesium chloride.

The rate of circulation of the electrolyte is controlled by several factors. The anode-cathode spacing is important. The less the space the greater will be the rate of upward circulation of the electrolyte in this space. In addition, the impurities in the form of oxygen and hydrogen containing materials, forming a part of the spray dried powdered feed material, is important in achieving the desired circulation rate since the additional gas generated as the cell feed is purified by reactions in the cell itself increases the rate of circulation.

As previously mentioned, the gases produced by contaminants which are vaporized as the cell feed material is deposited on the hot electrolyte are withdrawn through outlet 38. This may be termed a sanitary gas outlet as the gas, unlike the chlorine produced at outlet 42, has little commercial value. To increase the rate at which this sanitary gas is withdrawn sub-atmospheric pressure may be applied to outlet 38. This step results in the gases in the upper end of cell portion 44 being more quickly withdrawn, decreasing the opportunity of oxidation of the cell feed particles in the short instant after they are deposited onto the surface of the electrolyte through tube 24 until they are melted.

In the dehydration of magnesium chloride brine the two most deleterious components, as far as electrolytic cell feed is concerned, are commonly referred to as "water" and "magnesium oxide." A carefuly analysis indicates that the magnesium oxide is present in the melted feed as MgO and MgOHCl and that the "water" is presented primarily as MgOHCl. To assist in the description of the in situ purification process occurring in the cell the following simplified reactions are given by way of example and are not intended to be inclusive of all of the reactions occurring when the process is practiced:

A very small amount of hydrolysis occurs:

(a) $MgOHCl \rightarrow MgO + HCl$, the HCl appearing in the anode gas;

The bulk of the MgOHCl dissociates into two ions:

(b) $MgOHCl \rightarrow MgOH^+ + Cl^-$;

The chloride ion is attracted to the anode where chlorine gas is produced:

(c) $2CL^- \rightarrow Cl_2 + 2e^-$;

The $MgOH^+$ ions are attracted to the cathode where hydrogen gas and magnesium oxide are formed:

(d) $2MgOH^+ + 2e^- \rightarrow 2MgO + H_2$;

Magnesium oxide contained in the feed together with that produced at the cathode are chlorinated by two reactions which occur in the anode-cathode space;

(e) $2MgO + 2Cl_2 \rightarrow 2MgCl_2 + O_2$ (f) $MgO + Cl_2 + C \rightarrow MgCl_2 + CO$, the carbon coming such as from the graphite anode;

The magnesium chloride is electrolyzed to the co-products:

(g) $MgCl_2 \rightarrow Mg + Cl_2$;

The hydrogen reacts with oxygen produced in reaction (e) and with chlorine:

(h) $2H_2 + O_2 \rightarrow 2H_2O$ (i) $H_2 + Cl_2 \rightarrow 2HCl$; and

The CO from reaction (f) reacts with oxygen produced in reaction (e):

(j) $CO + \frac{1}{2} O_2 \rightarrow CO_2$, the carbon being derived by gradual depletion of the graphite anode, or the carbon monoxide may react as follows: $CO + MgO + Cl_2 \rightarrow CO_2 + MgCl_2$. The gaseous end products are found as minor impurities in the anode gas stream and are removed as previously described.

When the circulation rate is inadequate the magnesium oxide produced by reactions (b) and (d) become deposited on the surface of the cathode, causing cathode passivation and magnesium metal dispersions, with a serious reduction in cell efficiency. On the other hand, with the practice of the in situ purification process of this invention the magnesium oxide produced at the cathode by reaction (d) does not adhere to the cathode surface. Apparently it is carried away as fast as it forms, assisted by the hydrogen generated in reaction (d), and the high electrolyte circulation rate. A substantial portion of this magnesium oxide is swiftly chlorinated to magnesium chloride by reactions (e) and (f).

The gas producing reactions from the in situ purification of solid feed increases the gas lift effect in the anode-cathode space, thus enhancing the normal circulation of a cell of appropriate configuration. Accordingly, in the optimum use of this process the feeding rate and the duration of the feeding cycle is important. The process operates best when circulation continues at an optimum and steady rate and therefore the process is best practiced by depositing the powdered cell feed at a uniform and consistent rate onto the surface of the cell melt.

Several important economic advantages are achieved by the in situ purification process of this invention. The total energy that must be expended in the production of a pound of magnesium, including the power and fuel both for cell feed preparation and electrolysis, is reduced by about 2 KWH per pound of magnesium compared with presently used processes including those employing molten cell feed techniques.

Inasmuch as the productive capacity of commercial magnesium electrolysis cells is limited by their tendency to overheat, the amperage which can be impressed on the cell electrodes is limited by a particular eletrolyte temperature for each type of cell which must not be exceeded for efficient cell operation. The heat capacity of the solid feed spray dryer product which is associated with the in situ purification process of this invention changes the heat balance on the cell favorably, permitting a larger amperage to be impressed on the cell, for a given electrolyte temperature. Tests have demonstrated an increased cell output of about 12% when using the in situ purification process compared with the same cell using molten cell feed input. Tests indicate that the actual range of capacity improvement achieved by this invention will be from 10% to 20%, depending upon the details of the cell design used, compared with similar cell designs using molten feed input. Tests have also demonstrated that this process eliminates excessive sludge production, thereby reducing the cost of removal of the sludge and the loss of entrapped metal and reduces heating of the electrodes as occurs with excessive sludge accumulation.

The essence of this invention is the use of a particular powdered magnesium chloride cell feed in the form of discrete particles fed directly onto the surface of a circulating electrolyte in an electrolysis cell in such a way as to provide advantages and efficiencies over the known state of the art. The cell feed is produced by exposing a spray of concentrated magnesium chloride brine to a stream of dry hot air in an apparatus usually called a spray dryer. The result is a powder, which, upon close examination, has unique physical and chemical properties which, when utilized in the other steps of the process of this invention, result in the improved performances previously referred to.

Figure 2:
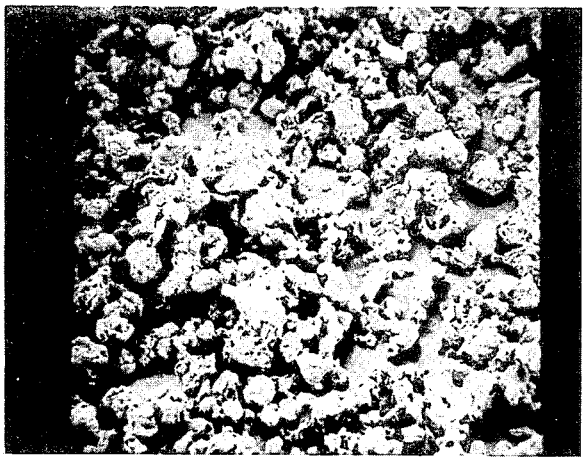
FIG. 2 is a photograph of the particles of magnesium chloride cell feed used in practicing the invention, the photograph being made by means of an electron microscope at a magnification of 200.

FIGS. 2, 3, 4 and 5 are photographs made by an electron microscope of samples of cell feed utilized in practicing this invention. FIG. 2 is a picture of the cell feed particles at a magnification of 200. It can be seen that the particles are discrete, irregular, non-crystaline and highly porous.

Figure 3:
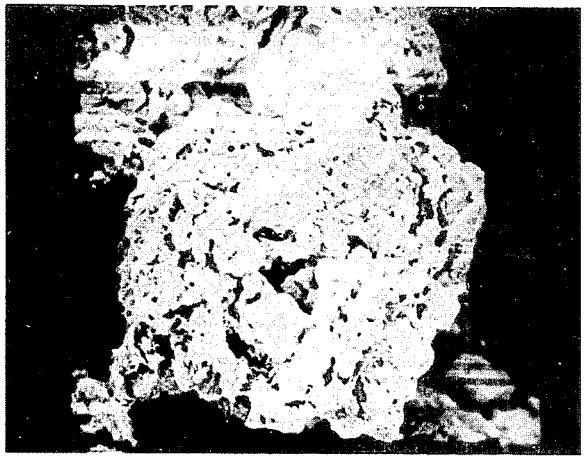
FIG. 3 is a photograph produced by an electron microscope showing essentially one particles of magnesium chloride cell feed at a magnification of 2000.
Figure 4:
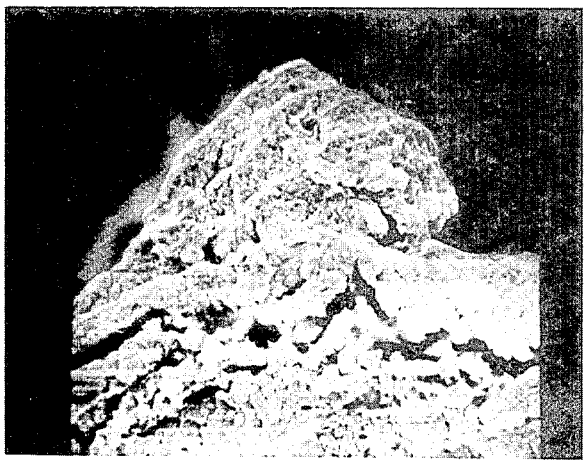
FIG. 4 is a photograph produced by an electron microscope showing a poartion of a particle of cell feed at a magnification of 5000.
Figure 5:
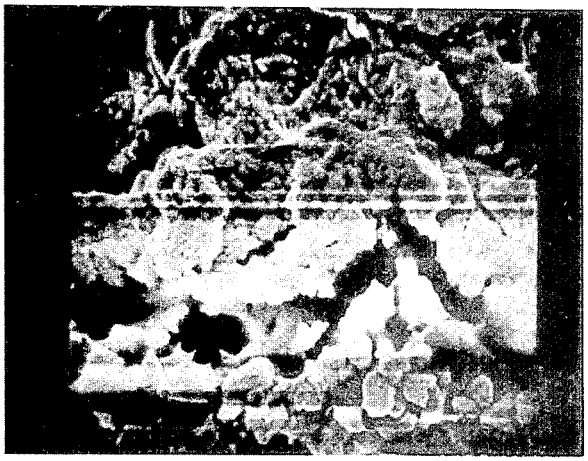
FIG. 5 is a photograph produced by an electron microscope showing an enlarged portion of the same particle as shown in FIG. 4, at a magnification of 10,000.

FIG. 3, taken at a magnification of 2000, FIG. 4, taken at a magnification of 5000 and FIG. 5, taken at a magnification of 10,000 discloses the unique highly porous nature of the particles. The invention provides a method of taking advantage of this great porosity of the discrete magnesium chloride particles as a cell feed directly chargeable into an electrolytic cell in a manner wherein final purification of the cell feed occurs within the cell itself without any intervening treatment between the dryer and the electrolytic cell.

The particles appear quasi-spheroid and roughly equi-axed. Occasionally a nearly perfect sphere is observed, along with split spheres or shells. The impression of the particle structures suggest that in the drying process the solid phase is separated from spherical liquid droplets by rapid homogeneous nucleation of highly supersaturated magnesium chloride. The vapor pressure within the initial solid is apparently high enough to cause extensive disintegration and occasional actual bursting of particles. Probably water vapor pressure builds up at defects and discontinuities throughout the solidified droplet. Dehydration then becomes autocatalytic in that the initial bursting action creates new surfaces and decreases diffusion distances, both of which factors accelerate release of water.

As the magnification of the particles is increased, as evidenced by the sequence of pictures of FIG. 3 through FIG. 5, new and finer scale porosity is disclosed. The extremely open final stages of the structure substantially eliminates any barriers to solid state diffusion of water.

The primary characteristic of these magnesium chloride particles which makes possible the improved results of the methods of this invention is the great average porosity of the particles, with the corollary high surface area per unit mass. More than 90% of the individual particles have a porosity greater than 30%. This characteristic has two important effects when the material is deposited on the surface of a cell electrolyte. First, remaining water and other oxygen and hydrogen carrying contaminants are easily and quickly evaporated away to be carried off with the sanitary gas. Second, the particles are quickly and expeditiously melted and carried into the electrolyte stream, thereby diminishing the opportunity for additional oxidation.

Although difficult to measure in physical terms, the nature of the magnesium oxide contaminant found in the magnesium chloride cell feed produced in a spray dryer seems to differ from that produced in other methods, such as fluid bed dryers. The magnesium oxide particle of the spray dryed feed seems to be not only smaller but also "sofer," that is, more readily reactable with the chlorine in the electrolyte. This characteristic is, as stated above, more apparent from the surprisingly improved results obtained from the invention, than by actual analysis of the cell feed contaminant itself.

The invention described fulfills all the objectives initially set forth. The best mode of carrying out the invention includes the steps of: (1) preparing a powdered cell feed having the properties of (a) discrete porous particles; (b) having a magnesium chloride content of at least 65%; (c) having an oxygen contaminant content of not more than 13% (d) having an hydrogen contaminant content of not more than 1% and (e) having an average particle porosity of at least 30%; (2) depositing the powdered cell feed directly onto the surface of molten electrolyte in an electrolytic cell in a portion of the cell isolated from the chlorine gas generated in the inter-electrode space; (3) withdrawing gases generated by vaporization of contaminants as the powdered feed contacts the surface of the hot electroyte; and (4) circulating the electrolyte at a rate sufficient to maintain most of the contaminant magnesium oxide in suspension. The circulation of the electrolyte may be achieved by proper cell design such that the buoyance of the electrolyte in the inter-electrode space caused by chlorine and other gases generated therein or the required circulation may be achieved by supplementary means, examples of which are disclosed.

The practice of this invention requires that the electrolyte be circulated upwardly in the inter-electrode space and downwardly in the area in which the powdered cell feed is deposited to carry the melted cell feed and entrained contaminants into the lower portion of the inter-electrode space. The minimum rate of circulation is difficult to state in terms such as feet per second, although the required rate is relatively easy to establish in practice. The rate must be such that most of the magnesium oxide particles are maintained is suspension. This precise rate will depend upon the primary factors of the particle size and density, and the electrolyte viscosity. When implementing the methods of this invention the operator can observe the sludge accumulation. The circulation rate should be adjusted by chancing the cell parameters, such as the inter-electrode space, until a rate of circulation is reached at which a further increase in circulation rate does not materially decrease the rate of sludge deposition. Putting it another way, the minimum rate of circulation of the electrolyte is that at which a reduction in the circulation rate produces a significant increase in the rate of sludge accumulation.

While the invention has been described with a certain degree of particularity it is manifest that many changes may be made in the steps of practicing the methods set forth herein, without departing from the spirit and scope of this disclosure. It is understood that the invention is not limited to the embodiments set forth herein, but is to be limited only by the scope of the attached claim or claims, including the full range of equivalency to which each step is entitled.

What is claimed is:

1. A method of producing magnesium metal and chlorine using $MgCl_2$ cell feed having hydrogen and oxygen impurities, comprising:

immersing spaced apart anode and cathode elements in a closed bath of molten electrolyte;

applying a voltage potential across the electrodes;

depositing the impure cell feed onto an area of the surface of the molten electrolyte, the impure cell feed being in the form of a powder of discrete porous particles in which the $MgCl_2$ content is at least 50%, the hydrogen contaminant content is less than 1%, the oxygen contaminant content is less than 13%, and the average porosity is greater than 30% at least a portion of the cell feed impurities being flash vaporized as the cell feed contacts the molten electrolyte;

withdrawing said impurities vaporized by contact of the impure cell feed with the surface of the molten electrolyte;

circulating the electrolyte upwardly in the inter-electrode space by the effect of gas produced therein, the electrolyte flowing up and out of the inter-electrode space towards the area where said cell feed is deposited;

circulating the electrolyte downwardly in the bath carrying said cell feed therewith into the lower portion of the inter-electrode space whereby at least a portion of the remaining impurities are chlorinated by chlorine gas generated at the anode element as the electrolyte rises in the inter-electrode space; and withdrawing chlorine gas produced at the anode and molten magnesium produced at the cathode from the cell.

2. A method of producing magnesium metal according to claim 1 wherein the circulation of electrolyte is at a rate sufficient to maintain at least a portion of the entrained cell feed impurities in suspension.

3. A method of producing magnesium metal according to claim 1 including:

introducing the impure powdered cell feed at a substantially continuous rate into the cell and onto the surface of the electrolyte; and maintaining the rate of circulation of the electrolyte sufficient to carry at least a portion of the impurities entrained until reacted with chlorine in the cell.

4. A method of producing magnesium metal according to claim 1 wherein the step of withdrawing the vaporized impurities from the cell includes the application of sub-atmospheric pressure to the cell adjacent the area of cell feed input.

5. A method of producing magnesium metal and chlorine from $MgCl_2$ containing brine, comprising:

injecting concentrated $MgCl_2$ containing brine into a spray dryer to contact the brine with a current of hot gas wherein most of the water is evaporated producing $MgCl_2$ cell feed in the form of discrete particles in which the hydrogen content is less than 1%, the oxygen content is less than 13%, the $MgCl_2$ content is at least 50%, and the average porosity of the particles is more than 30%;

separating the powdered $MgCl_2$ feed particles from the hot gas;

immersing spaced apart anode and cathode elements in a closed bath of molten electrolyte;

applying a voltage potential across the electrodes;

depositing the impure $MgCl_2$ feed particles onto an area of the surface of the molten electrolyte whereby a portion of the entrained impurities are vaporized as the feed particles contact the molten electrolyte;

withdrawing the vaporized impurities;

circulating the electrolyte upwardly in the inter-electrode space, the electrolyte flowing up and out of the inter-electrode space towards the area where said $MgCl_2$ feed is deposited;

circulating the electrolyte downwardly in the bath carrying said $MgCl_2$ feed therewith, the cell feed being rapidly melted by the electrolyte, the melted cell feed being carried into the lower portion of the inter-electrode space whereby at least a portion of the remaining impurities are chlorinated by chlorine gas generated at the anode element as the electrolyte rises in the inter-electrode space; and withdrawing chlorine gas produced at the anode and magnesium metal produced at the cathode from the cell.

6. A method of producing magnesium metal according to claim 5 wherein the step of separating the powdered $MgCl_2$ cell feed material from the hot gas is carried out in a cyclone separator.

7. A method of producing magnesium metal according to claim 5 wherein the circulation of electrolyte is at a rate sufficient to maintain at least a portion of the entrained cell feed impurities in suspension.

8. A method of producing magnesium metal according to claim 5 including:

introducing the impure powdered cell feed at a substantially continuous rate into the cell and onto the surface of the electrolyte; and maintaining the rate of circulation of the electrolyte sufficient to maintain in suspension at least a portion of the impurities entrained until reacted with chlorine in the cell.

9. A method of producing magnesium metal according to claim 5 wherein the step of withdrawing the vaporized impurities from the cell includes the application of sub-atmospheric pressure to the cell adjacent the area of cell feed input.

* * * * *